United States Patent [19]

Denny et al.

[11] Patent Number: 4,875,549

[45] Date of Patent: Oct. 24, 1989

[54] DEBRIS BARRIER

[75] Inventors: David S. Denny, Middle Haddam; Edward C. R. Metzger, Deep River; John Rexroad, Old Saybrook; William Glynn, West Suffield, all of Conn.

[73] Assignee: SINCO, Inc., East Hampton, Conn.

[21] Appl. No.: 328,627

[22] Filed: Mar. 27, 1989

Related U.S. Application Data

[63] Continuation of Ser. No. 174,006, Mar. 28, 1988, Pat. No. 4,815,562.

[51] Int. Cl.[4] ..... E04G 21/32

[52] U.S. Cl. ..... 182/138; 182/82; 52/63

[58] Field of Search ..... 182/138, 139, 140, 82, 182/47, 113; 52/63

[56] References Cited

U.S. PATENT DOCUMENTS

| | | | |
|---|---|---|---|
| 3,392,801 | 7/1968 | Gethmann | 182/132 |
| 3,949,834 | 4/1976 | Nusbaum | 182/138 |
| 3,995,715 | 12/1976 | Virtanen | 182/47 |
| 4,119,176 | 10/1978 | Verdu | 182/138 |
| 4,129,197 | 12/1978 | Preston | 182/138 |
| 4,574,534 | 3/1986 | Beaton | 182/47 |
| 4,732,234 | 3/1988 | Brickman | 182/138 |
| 4,738,335 | 4/1988 | Ishii | 182/138 |
| 4,805,735 | 2/1989 | Anderson | 182/138 |
| 4,815,562 | 3/1989 | Denny | 182/138 |

*Primary Examiner*—Reinaldo P. Machado

*Attorney, Agent, or Firm*—Chilton, Alix & Van Kirk

[57] ABSTRACT

A debris barrier for a high rise construction structure comprises a woven flexible mesh netting. A cord longitudinally extends along the top of the netting to form a reinforced border. The top of the netting is clipped to a safety cable so as to vertically suspend a portion of the netting. An anchoring strip is fastened to the netting. The netting is anchored to the floor slab by driving fasteners through the anchoring strip.

13 Claims, 4 Drawing Sheets

DEBRIS BARRIER

This is a continuation of co-pending application Ser. No. 174,006 filed on Mar. 28, 1988 now U.S. Pat. No. 4,815,562.

This invention relates generally to vertical debris barriers which are employed during the construction of high rise office buildings or the like. More particularly, the present invention relates generally to debris barriers which are installed to prevent debris and other objects from falling off the floor slab of a structure under construction.

Various federal, state and local laws and regulations, including those of the Federal Occupational Safety and Health Administration, require that safety barriers be employed during the construction of high rise office buildings and like structures. The principal purpose of such safety barriers is to prevent workers from accidentally falling off the edge of the floor slab. The safety barrier may also function to prevent debris, tools, materials and other objects from accidentally falling off a floor slab during construction. The pertinent safety standards commonly require that during construction, a rope, cable or hand rail be suspended above the height of the floor slab so as to extend vertically at the perimeter of the slab. Typically, the cable is suspended approximately 42 inches above each floor slab. A second cable is also typically suspended midway between the floor slab and the 42 inch cable. A rigid toe board of 5 inch or greater width is also typically rigidly secured along the floor slab at or near the perimeter to prevent debris, tools, materials and other objects from being accidentally kicked or dislodged off the floor slab.

There are a number of additional prior devices and safety barrier systems which generally relate to the field of the invention. E. Whitney U.S. Pat. Nos. 1,244,670, Preston, 4,012,197 and Verdu 4,119,176 disclose devices and/or systems Which generally relate to the subject matter of the invention.

SUMMARY OF THE INVENTION

Briefly stated, the invention in a preferred form is a debris barrier which comprises an elongated sheet of flexible mesh netting. A top border portion of the netting forms means for securing a cord. The cord generally extends longitudinally along the netting to provide a flexible reinforced border portion. A flexible anchoring strip of heavy duty material is secured to the netting intermediate the top and opposing second borders and is generally uniformly transversely spaced from the top border. In one embodiment, the netting forms a longitudinally extending mesh channel which is defined by connected folded flat portions of the mesh netting. A flexible anchoring strip of heavy duty material has a uniform width which ranges from 1½ to 2½ inches. The anchoring strip is fastened to the mesh netting and extends longitudinally to form a base for securing the netting to the floor. In one embodiment, the transverse spacing between the top border and the anchoring strip is approximately 5 feet, and the transverse spacing between the strip and the second border portion is approximately 8 inches or greater. The mesh netting preferably comprises a ⅛ inch woven mesh of flexible foam vinyl and polyester.

The debris barrier is especially adapted to function as a vertical debris barrier system for high rise construction projects wherein a safety cable is suspended at a substantially uniform height above a floor slab along at least a portion of the perimeter or vicinity thereof. The mesh netting has a transverse dimension which is greater than the height of the cable from the floor. The netting is suspended from the cable by means of clips which connect at longitudinally spaced locations. The netting is dimensioned so that one portion of the netting extends generally vertically and a second portion is positionable on the floor slab in surface-to-surface relationship so as to form a generally perpendicular flap. A longitudinally extending anchoring strip of flexible material is fastened to the netting and positioned generally at the intersection of the netting and the flap portion. Roof-type fasteners are employed to secure the anchoring strip and netting to the floor at longitudinally spaced locations along the strip.

A method in accordance with the present invention for installing a debris barrier on a high rise construction structure comprises connecting spaced border portions of a netting to a safety cable at longitudinally spaced positions therealong so as to vertically suspend a portion of the netting. Portions of the netting are positioned on the floor slab to form a longitudinally extending flap which extends generally perpendicular to the suspended netting. The netting is fastened to the floor slab by means of roof fasteners at longitudinally spaced locations at or near the intersection of the flap and vertically suspended netting portion.

An object of the invention is to provide a new and improved debris barrier and a method for installing a debris barrier system for high rise construction projects and the like.

Another object of the invention is to provide a new and improved debris barrier which is cost-effective and may be installed on a high rise construction project in an efficient and safe manner.

Another object of the invention is to provide a new and improved debris barrier which provides a high degree of safety.

A further object of the invention is to provide a new and improved debris barrier which satisfies governmental regulations for safety toe boards.

Other objects and advantages of the invention will become apparent from the drawings and the specification.

DETAILED DESCRIPTION OF THE INVENTION

Figure 1:
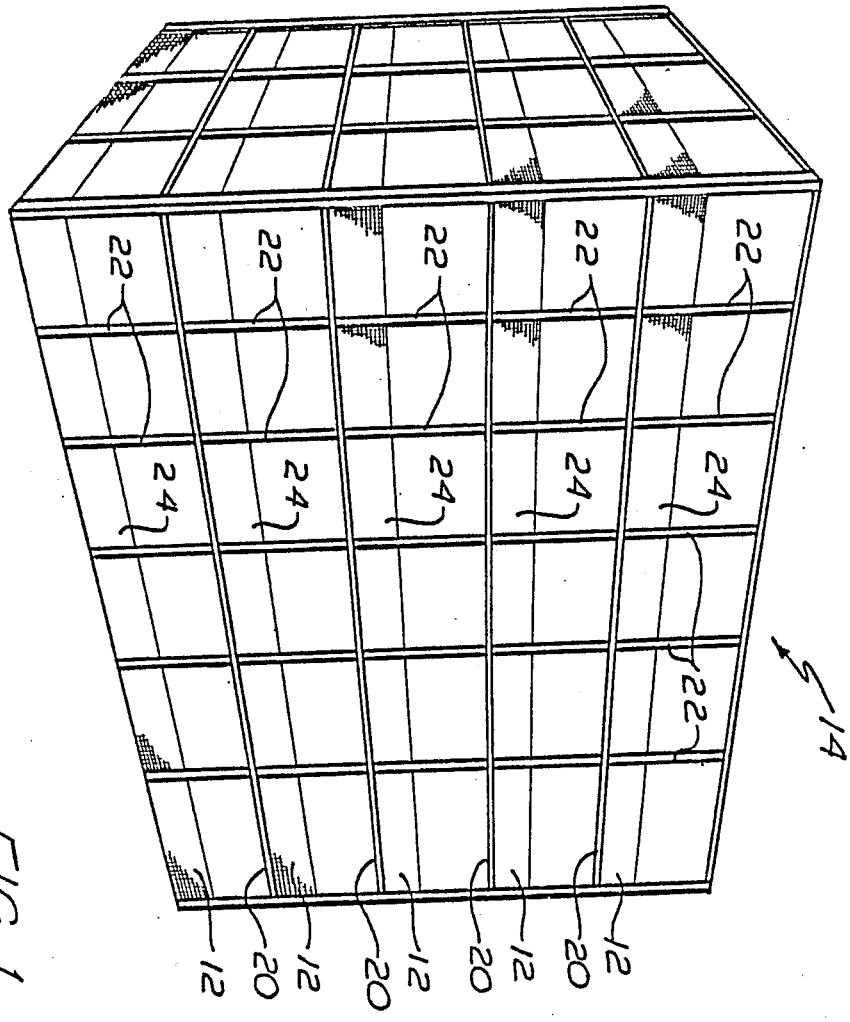
FIG. 1 is a perspective view illustrating an idealized high rise construction structure and a plurality of installed debris barriers in accordance with the present invention.

With reference to the drawings wherein like numerals represent like parts throughout the figures, a debris barrier system designated generally by the numeral 10 incorporates a debris barrier 12 to provide a safety system having particular applicability in high rise construction projects. An idealized high rise construction structure is generally designated by the numeral 14 in FIG. 1. It will be appreciated that a debris barrier 12 may be installed at each floor or level of the structure 14.

The debris barrier system 10 is employed to prevent debris, tools, materials and other objects from being accidentally kicked, blown or from falling off of the floor slab of the high rise construction project. In addition, the debris barrier in combination with required cables is capable of withstanding substantial impacts so as to also prevent workers from accidentally falling off the uncompleted construction structures. The barrier system 10 may also function as a windbreak to decrease the wind currents on the floor slab. The barrier system 10 additionally provides enhanced visibility compared to prior related systems.

At each level of the structure 14, the floor slab 20 at the perimeter is at least partially open. Vertical support posts 22 extend from the horizontal floor slab 20 at or near the floor slab periphery. A safety cable 24 is suspended between the posts 22 and extends at least a peripheral portion or an approximate peripheral portion of the floor slab 22. Pertinent safety regulations conventionally mandate that the safety cable 24 must be located at a substantially uniform height, typically in the range of 42 to 60 inches, above the floor slab 20. A second safety cable 26 (FIG. 2) which may be identical in form and function to safety cable 24, is typically suspended between posts 22 approximately midway between cable 24 and the floor slab 20 or at a preselected height in generally parallel relationship therewith. Other cables may also be provided. The cables may also be suspended from auxiliary posts or structures rather than the illustrated support posts 22. It should be appreciated that safety cables 26 and 24 are conventionally mandated for high rise building construction projects and their specific construction and method of mounting are conventional.

The debris barrier 12 in accordance with the present invention comprises a flexible mesh netting 30 which preferably has a generally uniform width and a semi-continuous-type form. The netting may be manufactured in 50 foot sections. In one embodiment, the uniform width of the netting of the finished barrier product is approximately 6 feet. The finished netting 30 has an upper border 32 and a parallel lower border 34 as well as longitudinally spaced parallel side borders 36 and 38 for each netting section. The lower border 34 may be a single ply edge of netting or a dual ply netting band.

The mesh netting 30 in a preferred embodiment comprises a ⅛ inch woven mesh of "arlyn" yarn composition having a 0.028 mil diameter and a weight of approximately 8 ounces per square yard. The woven yarn composition is composed of pigmented flexible foam polyvinyl chloride having approximately 78% foam vinyl and 22% 1000 denier polyester composition. The netting fabric in one embodiment is heat set and blown to the desired specifications and is flame retardant to a degree which is essentially self-extinguishing. The woven netting fabric has approximately 7 strands per inch warp and 5 strands per inch fill (weft). The tensile strength of the described netting material is warp-100 lbs./sq.in. minimum and fill-74 lbs./sq. in. minimum (ASTM-D1682-75). The Mullen Burst strength is determined to be a minimum of 270 lbs. per square inch (ASTM-D3786). The netting fabric is also abrasion resistant having a 500 cycle rating of 4.5 minimum warp and 4.5 minimum fill (ASTM-4157-82). The netting may also have a safety pigment which is resistant to ultra violet radiation.

Figure 3:
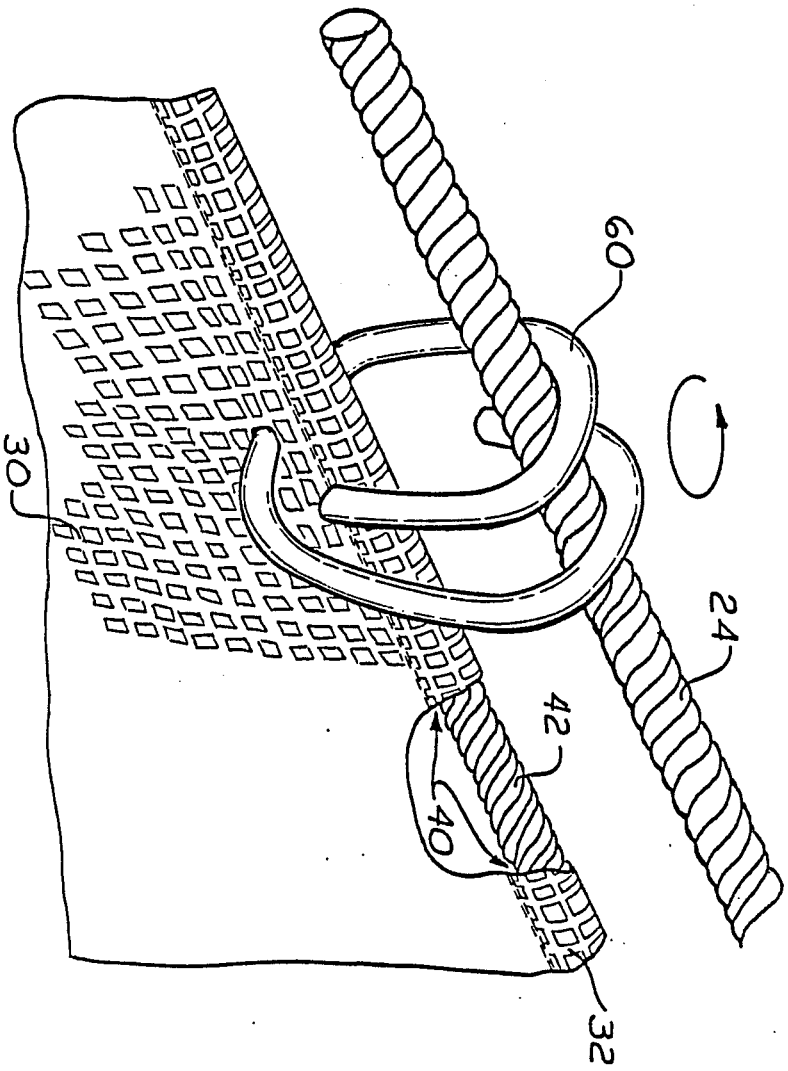
FIG. 3 is an enlarged fragmentary perspective view, partially broken away to show detail, of a top portion of the debris barrier of FIG. 2.
Figure 4:
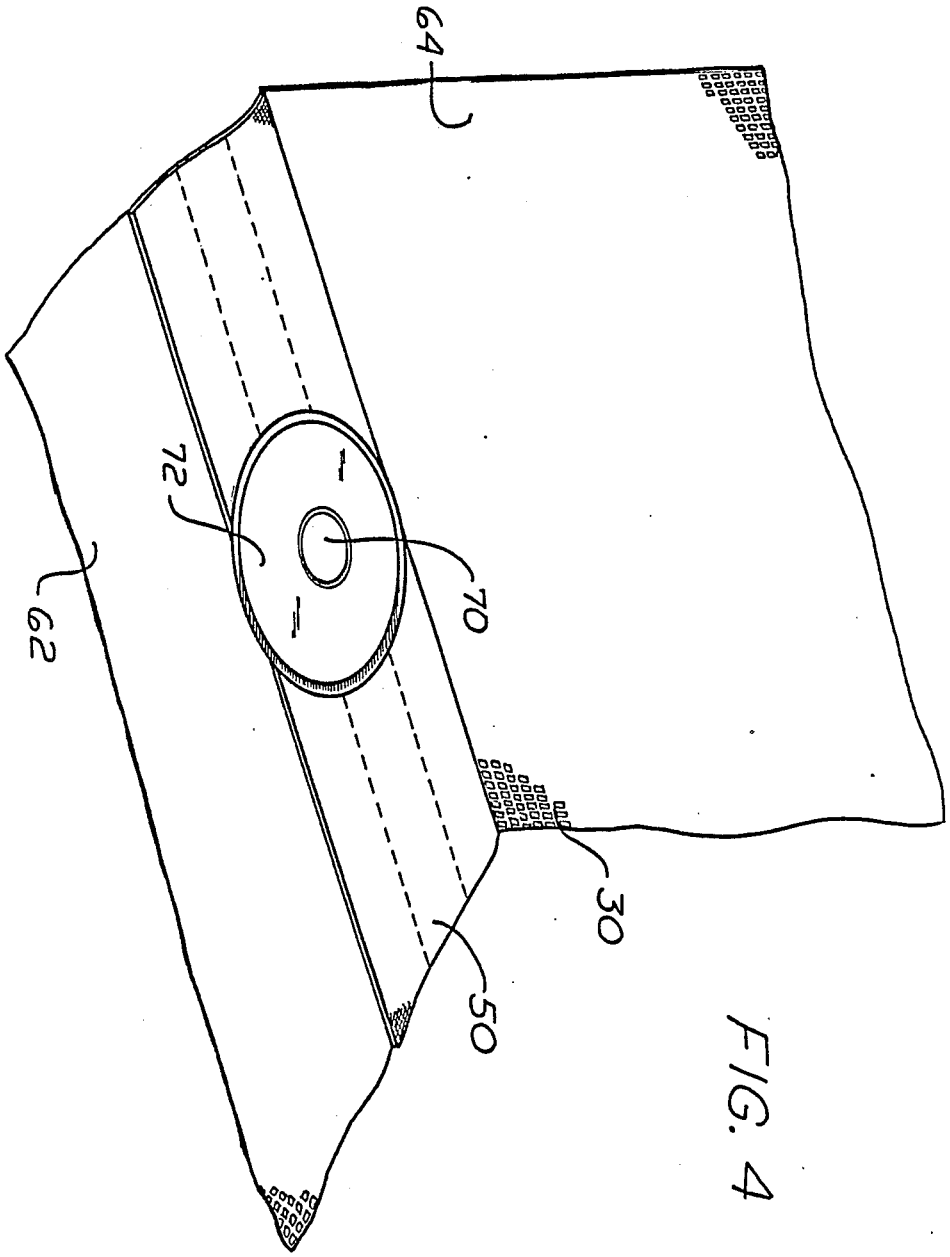
FIG. 4 is an enlarged fragmentary perspective view of a lower portion of the debris barrier of FIG. 2.

The upper border 32 is formed by folding and looping the netting fabric so as to form a longitudinally extending mesh channel 40 as best illustrated in FIG. 3. A cord 42 is inserted through the channel 40. Alternatively, the channel defining netting is looped over the cord and secured together. The cord 42 extends the longitudinal length of the netting and cooperates to provide an upper reinforcement-type border structure to the netting. The upper border 32 typically has a transverse width of approximately one-half inch. In one embodiment, the cord 42 is constructed from a DuPont #728 high tenacity nylon material having a diameter of 0.170 inch and a tensile strength of 1200 lbs. Mesh channels are also formed at the side borders 36 and 38 and the cord 42 extends therethrough. The debris barrier netting may thus be essentially described as comprising an elongated flexible rectangular section of woven material having a flexible reinforced structure at the two opposing ends and the top border thereof.

A heavy duty, nylon filament strip of webbing 50 is stitched or otherwise fastened to one side of the mesh netting 30 so as to extend longitudinally generally parallel to the upper border 32. The webbing typically has a transverse width in the range of approximately 1½ to 2½ inches and a minimum break strength of 6000 lbs. In a preferred embodiment, the nylon webbing strip 50 is uniformly spaced approximately 5 feet from the upper border 32. The webbing strip 50 functions to provide a reinforcement panel for fastening or anchoring the netting to the floor slab.

The lower border 34 may have a transverse width of ¾ inch. In some embodiments, the lower border is essentially the edge of a single ply of the mesh netting 30. The foregoing described debris barrier 30 has been tested in a rigid 10 foot by 10 foot frame and found to withstand a maximum static load of 1,200 lbs.

Figure 2:
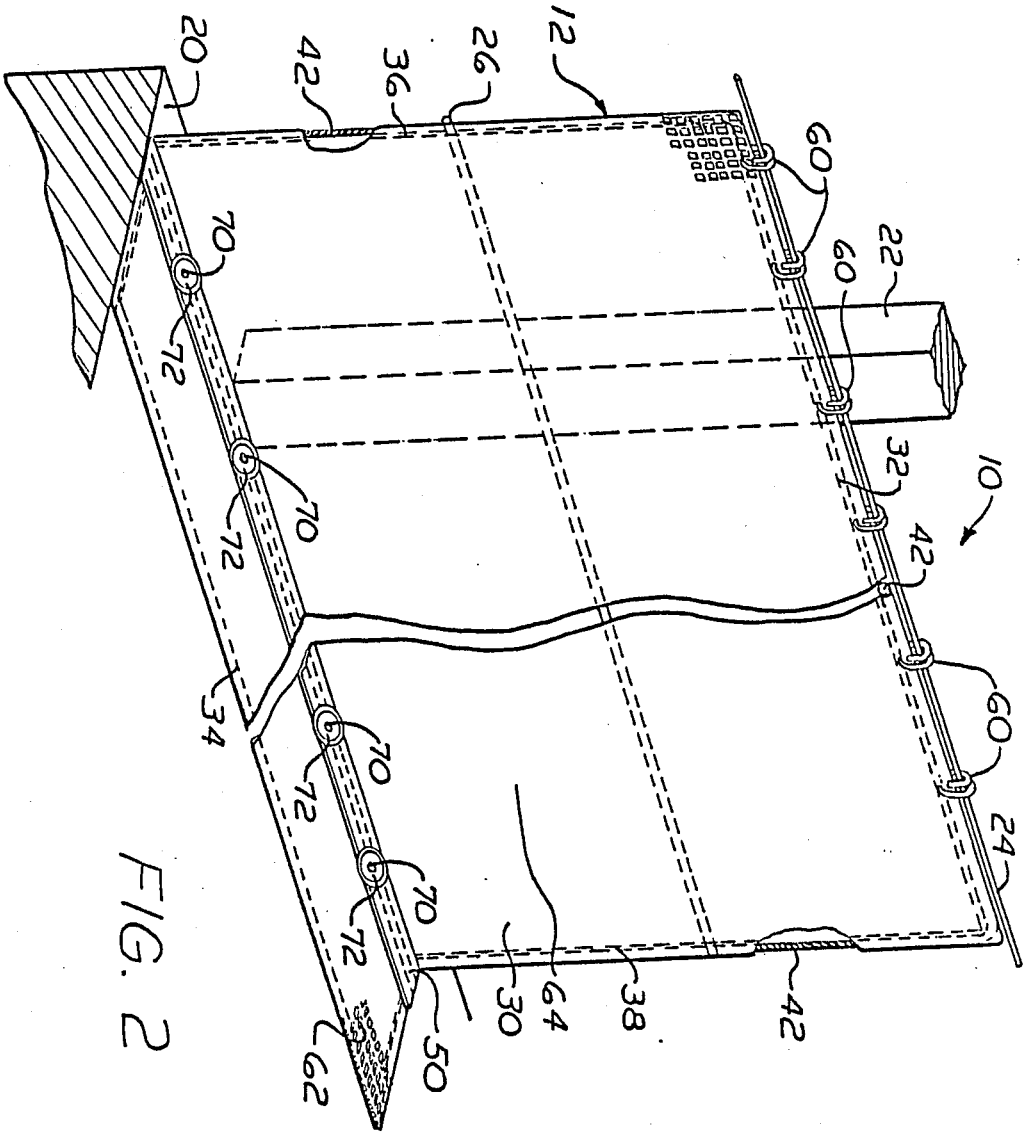
FIG. 2 is an enlarged perspective view, partially broken away, illustrating a debris barrier system incorporating a debris barrier in accordance with the present invention.

The described debris barrier 30 is installed by suspending portions of the upper border 32 from cable 24. Clips 60, having a continuous compound U-shaped configuration, are slipped through an opening in the mesh netting just below the border cord 42 at longitudinally spaced locations along the netting. In one embodiment, the clips are manufactured from 0.156 gauge steel. The clips 60 are typically located every two feet along the netting. Each clip 60 is dimensioned and bifurcated to allow the clip to slide over the cable at one angular orientation of the clip. Upon rotation (in the general direction of the FIG. 3 arrow) and release of the clip 60, the clip and connected netting is freely suspended from the cable 24, as best illustrated in FIGS. 2 and 3. The foregoing installation process is replicated until the upper portion of the entire section of netting is eventually suspended from the cable as illustrated in FIGS. 1 and 2.

The debris barrier 30 is preferably dimensioned relative to the height of the cable 24 above slab 20 so that the netting portion underlying and between the strip 50 and the lower border 34 is horizontally positionable in a quasi-smooth surface to surface relationship along the floor slab 20. The resultant horizontal barrier component essentially forms a debris floor flap 62 which rests on the floor slab and extends generally perpendicularly to the vertically suspended netting portion 64 of the debris barrier. The webbing strip 50 is dimensioned and positioned relative to both the netting and the cable height so that it is generally located in the vicinity of the formed intersection between the flap 62 and the vertical netting portion 64. The webbing strip 50 is positioned toward the second border portion 34 from the intersection so as to horizontally rest on the floor slab 20. For example, for an application where the top safety cable 24 is 60 ins. above the floor slab, the transverse distance between the upper border 32 and the webbing strip 50 is approximately 60 ins. and the flap 62 is approximately 12 inches wide.

Nails 70 or other suitable fasteners are driven through conventional roofing fastener plates 72 to secure the debris barrier to the floor slab 20. The plates 72 are positioned at longitudinally spaced positions along the webbing strip 50. A powder actuated driver other means may be suitably employed to drive the nails 70 into the floor slab to thereby secure the lower portions of the debris barrier to the floor slab. The fasteners are preferably spaced approximately every 5 feet along the debris barrier.

A debris barrier 12 in accordance with the present invention which was installed as described herein has been found to withstand an orthogonally directed impact against the vertical netting portion 64 in excess of 900 lbs. It should be appreciated that the debris barrier system 10 as described does not require the conventional rigid toe board yet provides a debris barrier which is at least equal, and in many cases exceeds, the impact specifications provided by safety barriers employing the conventional toe board-type structure.

The adjacent debris barrier sections may be clipped together by means of clips 60 or other fasteners by overlapping end portions of the sections and fastening together the overlapping portions. It should be appreciated that the foregoing debris barrier system 10 can be both installed and dismounted in a very efficient manner. The debris barrier may be dismounted by pulling the fasteners from the floor slab and releasing the clips 60 or other cable/netting fasteners. The clips 60 may be released from the cable by merely raising the clips and the suspended netting, twisting the clip and releasing same from the cable by allowing the clip/netting to fall toward the floor slab under the force of gravity.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A debris barrier system for high rise construction projects adapted for installation in connection with a safety cable suspended at a generally uniform height above a floor slab along at least a portion of the perimeter vicinity thereof comprising:

a flexible netting having a first border portion and a second transversely spaced border edge separated by a distance greater than said height;

clip means for connecting said netting to said cable at longitudinally spaced locations along said netting to suspend said netting so as to form a flexible vertical panel and a flap horizontally positionable on said floor slab;

a flexible anchoring strip spaced from said first border portion a distance approximately equal to the cable height and extending longitudinally along said netting; and fastener means for fastening said netting to said floor slab at longitudinally spaced positions along said flexible anchoring strip.

2. A debris barrier comprising:

an elongated sheet of flexible netting having a first border portion and a second transversely spaced border edge;

said first border portion being formed of a flexible reinforced material which is capable of supporting said netting upon suspension thereof; and an anchoring strip comprising a flexible tear-resistant material generally uniformly transversely spaced from said first border portion.

3. The debris barrier of claim 2 wherein the transverse spacing between said first border portion and said anchoring strip is approximately five feet.

4. The debris barrier of claim 2 wherein the netting comprises a woven mesh of strands comprised of vinyl and polyester material.

5. The debris barrier of claim 4 wherein the woven mesh is approximately ⅛ inch and the strands are approximately 0.028 mil diameter.

6. The debris barrier of claim 2 further comprising a multiplicity of clips connectable at said first border portion for suspending said netting from a cable.

7. The debris barrier system of claim 1 wherein said clip means comprises a multiplicity of clips, each said clip having a continuous spaced dual, substantially U-shaped catch and being insertable through said netting and removably mountable to said cable.

8. The debris barrier system of claim 1 wherein said first border portion has a reinforcement cord extending therealong and said clips extend through said netting so as to receive portions of the cord.

9. The debris barrier system of claim 1 wherein the fastener means comprises fasteners and fastener plates engaging against said anchoring strip, said fasteners being driven through said fastener plates to anchor said debris barrier to said floor slab.

10. A method for installing a debris barrier on a high rise construction project wherein a safety cable is suspended a generally uniform height above a floor comprising:

(a) providing an elongated flexible netting having a first border portion, a traverse width greater than said height; and an anchoring strip which is transversely spaced from said first border portion a distance approximately equal to said cable height;

(b) connecting longitudinally spaced portions of said first border portion to said cable so as to vertically suspend portions of said netting;

(c) positioning said anchoring strip on said floor; and (d) fastening said netting to said floor at longitudinally spaced locations along said anchoring strip.

11. The method of claim 10 wherein step (d) further comprises driving fasteners through said anchoring strip into said floor.

12. The method of claim 10 wherein step (d) further comprises positioning plates along said anchoring strip and driving fasteners through said plates and anchoring strip into said floor.

13. The method of claim 10 wherein step (b) further comprises inserting clips through openings of said netting and suspending said clips from said safety cable.

* * * * *